US008345903B2

(12) United States Patent
Flaig et al.

(10) Patent No.: US 8,345,903 B2
(45) Date of Patent: Jan. 1, 2013

(54) HOUSING FOR A HEARING DEVICE WITH SECURING ELEMENT

(75) Inventors: Uwe Flaig, Feucht (DE); Michael Sattler, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 500 days.

(21) Appl. No.: 12/707,768

(22) Filed: Feb. 18, 2010

(65) Prior Publication Data

US 2010/0208925 A1 Aug. 19, 2010

(30) Foreign Application Priority Data

Feb. 18, 2009 (DE) ..... 10 2009 009 502

(51) Int. Cl.
*H04R 25/00* (2006.01)

(52) U.S. Cl. ..... 381/322; 381/330; 381/323; 381/324; 381/381

(58) Field of Classification Search ..... 381/330, 381/322, 323, 324, 381
See application file for complete search history.

(56) References Cited

U.S. PATENT DOCUMENTS 5,799,095 A * 8/1998 Hanright ..... 381/312
6,144,749 A * 11/2000 Fideler ..... 381/323
2007/0081684 A1 4/2007 Crook

FOREIGN PATENT DOCUMENTS

EP 0 674 465 12/1994

* cited by examiner

*Primary Examiner* — Curtis Kuntz
*Assistant Examiner* — Amir Etesam
(74) *Attorney, Agent, or Firm* — Schiff Hardin LLP

(57) ABSTRACT

A battery bay of a hearing device should be better protected against unwanted opening. A housing for a hearing device is therefore provided with: a battery bay that is mounted on the housing and can be moved into an open position as well as a closed position; a projection that is permanently attached to the housing, and a securing element to prevent a movement of the battery bay. The securing element is supported on the battery bay and can be pivoted between a secured position and an unsecured position. The securing element also engages behind the projection in the secured position and the closed position of the battery bay so that the battery bay cannot be moved into the open position. The securing element has a recess in which, in the secured position, a tool can be held to move the securing element into the unsecured position.

10 Claims, 5 Drawing Sheets

HOUSING FOR A HEARING DEVICE WITH SECURING ELEMENT

BACKGROUND OF THE INVENTION

1. Field of the Invention

The present invention concerns a housing for a hearing device of the type having a battery bay that is supported on the housing and can be moved into an open position and a closed position; a projection that is permanently attached to the housing; and a securing element to prevent a movement of the battery bay. As used herein a hearing device means any sound-outputting system that can be worn on or in the ear or on the head, in particular a hearing system, a headset, a headphones and the like.

2. Description of the Prior Art

Hearing aids are wearable hearing devices that serve to assist hearing impaired persons. In order to accommodate numerous individual needs, different designs of hearing devices are provided, such as behind-the-ear hearing devices (BtE), hearing devices with external earpiece (RIC: receiver in the canal) and in-the-ear hearing devices (ItE), as well as concha hearing devices or canal hearing devices, for example (ITE, CIC). The hearing devices listed as examples are worn on the outer ear or in the auditory canal. Moreover, bone conduction hearing devices, implantable or vibro-tactile hearing devices are commercially available. Stimulation of the damaged hearing anatomy ensues either mechanically or electrically.

Hearing devices in principle have basic components that include an input transducer, an amplifier and an output transducer. The input transducer is normally a sound receiver (for example a microphone) and/or an electromagnetic receiver (for example an induction coil). The output transducer is most often realized as an electroacoustic transducer (for example miniature speaker) or as an electromechanical transducer (for example bone conduction earpiece). The amplifier is typically integrated into a signal processing unit. This basic design is shown in FIG. 1 in the example of a behind-the-ear hearing device. One or more microphones 2 to receive the sound from the environment are installed in a hearing device housing 1 to be worn behind the ear. A signal processing unit 3 that is likewise integrated into the hearing device housing 1 processes the microphone signals and amplifies them. The output signal of the signal processing unit 3 is transferred to a speaker or earpiece 4 that outputs an acoustic signal. The sound is possibly transmitted to the eardrum of the device wearer via a sound tube that is fixed in the auditory canal with an otoplastic. The power supply of the hearing device, and in particular that of the signal processing unit 3, ensues from a battery 5 that is likewise integrated into the hearing device housing 1.

Hearing devices normally have a battery bay in which the hearing device battery is housed. This battery bay can most often be pivoted out from the hearing device housing. In an open position of the battery bay, the battery can be removed from the battery bay. In the closed position of the battery bay, the battery bay is pivoted into the housing and the battery has contact with the hearing device electronics.

In many cases the battery bay has a small projection whose purpose is to make it possible to open the battery bay simply with a fingernail. However, the unintentional or unwanted opening of the battery bay of a hearing device should be prevented. This is necessary in order to prevent a small child from possibly swallowing the battery located in the battery bay.

Hearing devices are known in which a force of less than 10 N is sufficient to open the battery bay. This known solution consists of a latch that can be displaced in the axial direction with the aid of a small screwdriver, which latch is mounted on an axle. The latch and the axle are part of the battery bay, which also accommodates the battery. The latch engages one of two housing pins that can also be used to switch the hearing device on and off by means of the battery bay.

SUMMARY OF THE INVENTION

An object of the present invention is to better lock the battery bay of a hearing device against an unwanted opening.

According to the invention, this object is achieved by a housing for a hearing device with a battery bay that is mounted on the housing and can be moved into an open position as well as a closed position; a projection that is permanently attached to the housing; and a securing element to prevent a movement of the battery bay, wherein the securing element is supported on the battery bay and can be pivoted between a secured position and an unsecured position. The securing element engages behind the projection in the secured position and the closed position of the battery bay so that the battery bay cannot be moved into the open position. The securing element has a recess in which, in the secured position, a tool can be received to move the securing element into the unsecured position.

In the secured position, the securing element advantageously prevents movement of the battery bay. Only if the securing element is pivoted from the secured position into the unsecured position (in that a tool is held in the recess of the securing element) is the securing element no longer engaged with the projection of the housing, and the battery bay can be opened.

In the secured position the securing element is advantageously flush with the surface of the battery bay. In operation of the hearing device, the securing element therefore does not disruptively stick out from the battery bay.

Moreover, an opening can be fashioned in the battery bay through which only the recess of the securing element can be reached with the tool. In particular, the opening, bordered by the securing element, can form a slit on the surface of the battery bay whose maximum dimension is at most 3 mm and in particular is 2 mm or less. Therefore it is very difficult for small children to move the securing element with fingernails or with teeth.

According to a further embodiment, the battery bay can be locked in the closed position with the securing element in the unsecured position. This has the advantage that the user can tactilely recognize the closed position of the battery bay and moreover can operate the securing element without the battery bay coming open again after being closed.

Moreover, the battery bay can be mounted on the housing such that it can pivot. A robust mechanism in order to open or close the battery bay is hereby provided.

According to a further embodiment, the securing element can have a retaining surface that, in the secured position of the securing element, rests on the projection of the housing and is angled by less than 30° (advantageously less than 10°) relative to a plane in which a contact point of the securing element with the projection and the pivot axis of the battery bay lie. With this inclination the securing element is firmly drawn into the secured position if it is sought to open the battery bay when the securing element is, however, located in the secured position. Moreover, a latching of the securing element on a round housing projection is possible via this slight inclination.

Furthermore, the securing element can possess a pressure surface against which the projection of the housing presses if the battery bay is moved into the closed position so that the securing element is pressed into the unsecured position. The user thereby receives a tactile or optical indication that the battery bay is still not secured when the user has closed it.

Moreover, the securing element can have a stop that ends the movement of the securing element upon pivoting into the secured position. This ensures that the securing element can be pivoted out of the battery bay only to a certain degree.

DESCRIPTION OF THE PREFERRED EMBODIMENTS

Figure 1:
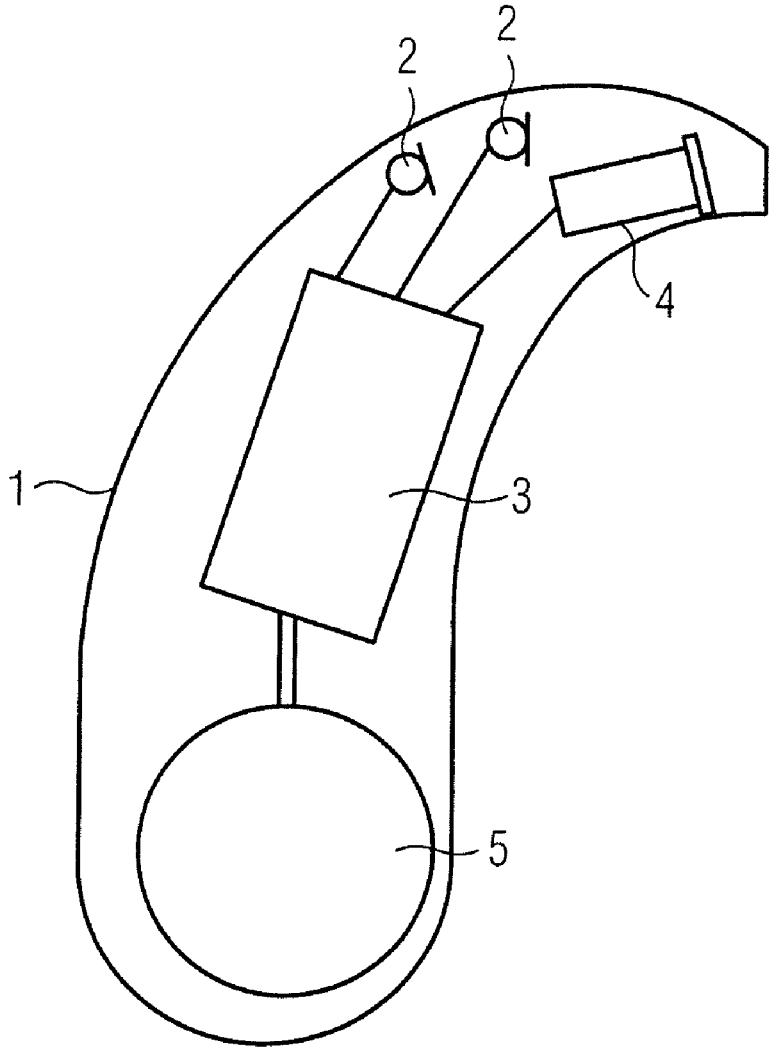
FIG 1 (Prior art)
FIG. 1 shows the basic design of a hearing device according to the prior art.
Figure 2:
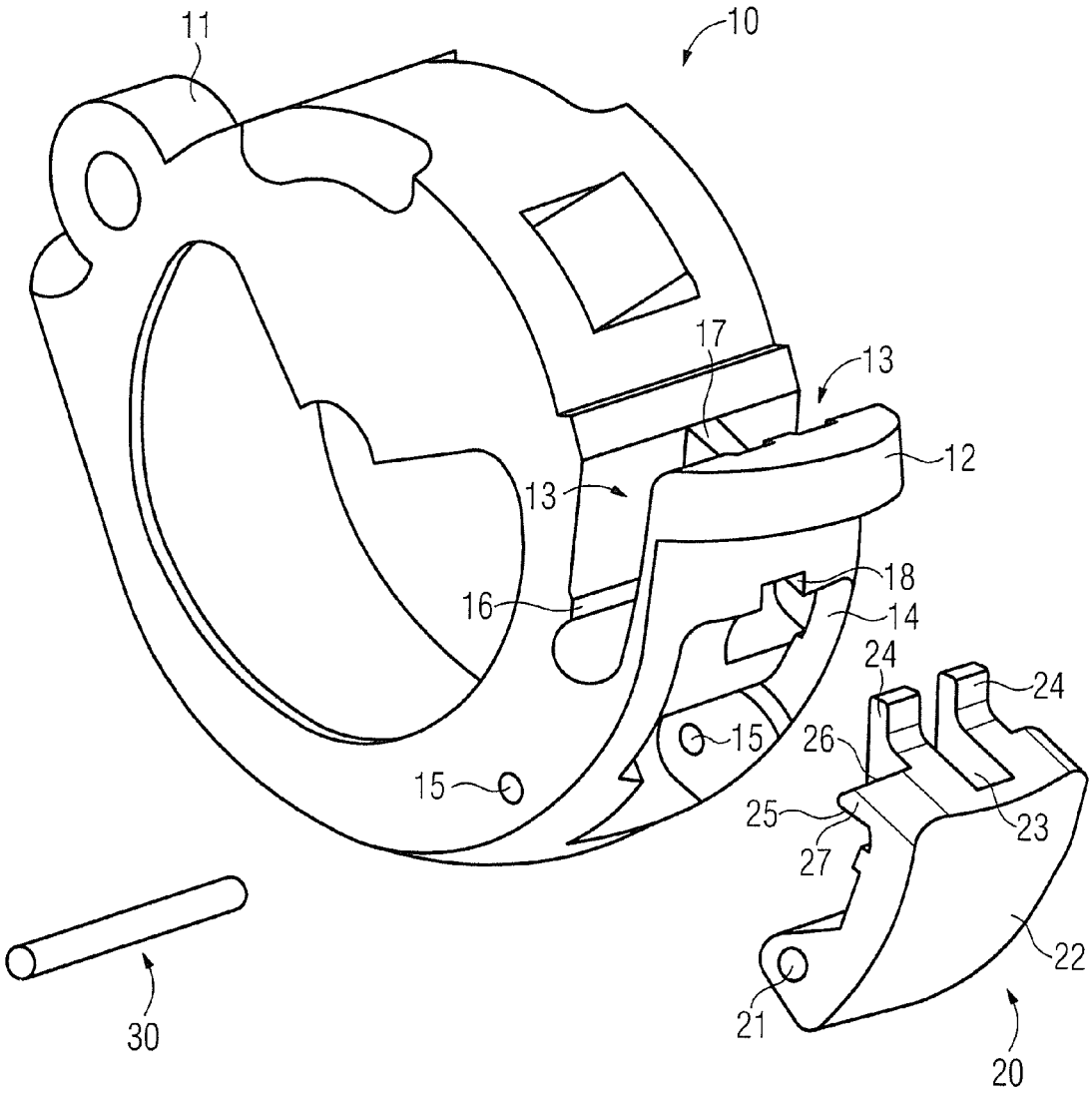
FIG. 2 is an exploded view of a battery bay with securing element and bearing.

A battery bay 10 as a one-part injection molded part is shown in FIG. 2. Furthermore, the Figure shows in an exploded view a securing element and a shaft or, respectively, a pin 30 with which the securing element 20 can be attached to the battery bay 10 so that it can be pivoted. The battery bay 10 is essentially formed in the shape of a pot in order to be able to accommodate a button battery. A socket-shaped molded part 11 is located on the outside, with which molded part lithe battery bay 10 is borne such that it can be pivoted on a corresponding axis. Located approximately opposite this socket-shaped molded part 11 is a grip element 12 by means of which a user can open the battery bay 10 with his fingernail. Below the grip element 12, the battery bay possesses two pocket-shaped recesses 13 that are open towards the facing sides of the approximately cylindrical battery bay 10. Moreover, both recesses 13 are open in the circumferential direction relative to a circle around the pivot axis of the battery bay. A projection or pin penetrates into the two recesses 13 upon closing the battery bay. Each recesses 13 has a projection 16 that protrudes from the inner surface of the recess 13 and runs parallel to the axis of the cylindrical battery bay 10. Moreover, the two recesses 13 are separated at least in sections by a radially traveling wall 17, approximately in the axial center of the battery bay 10. The wall 17 also serves to stabilize the grip element 12.

Furthermore, the battery bay 10 has a well 14 that is radially offset somewhat from the grip element 12 relative to the middle axis of the battery bay above the recesses 13 and in the circumferential direction, which well 14 is open to the outside and to the recesses 13. The securing element 20 can be inserted flush into the well 14. With the aid of the pin 30, the securing element 20 is supported such that it can be pivoted into corresponding bores 15 of the battery bay 10.

To accommodate the pin 30, the securing element 20 likewise has a bore 21. Moreover, it has a control surface 22 that has the same curvature as the battery bay in the region of the well 14 and that is pressed to secure the battery bay 10 so that the securing element 20 is pivoted or pushed into the well 14. The securing element 20 also has a recess 23 that can be engaged (for example with the aid of a small screwdriver) in order to push the securing element 20 from the secured position (securing element 20 in the well 14) into the unsecured position (securing element 20 from the well 14). In order to reach the recess 23 of the securing element 20 from the outside, the battery bay 10 has a recess 18 directly at the well 14. Together with the securing element 20, in its secured position it forms a slit into which only a small screwdriver can be inserted. However, the slit is small enough so that a child cannot engage his or her fingers in the recess 23 of the securing element 20 nor penetrate it with teeth.

Furthermore, the securing element 20 here possesses two stops 24 that prevent the securing element 20 from being able to be randomly pivoted out from the battery bay 10. In this example, two stops 24 are provided between which the wall 17 of the battery bay 10 runs in the inserted state of the securing element 20. In principle, a stop is naturally sufficient in order to achieve the desired function. In the unsecured position of the securing element 20, the stops 24 butt against a segment of the battery bay 10, for instance below the grip element 12, as this will be explained in detail in connection with FIGS. 5 and 7, for example.

Lastly, the securing element 20 has a wedge-shaped molded part 27 with retaining surface 25, of which only one on the back side is recognizable in FIG. 2. These surfaces 25 run approximately tangential relative to the pivot axis of the securing element 20. The retaining surfaces 25 engage on a projection or, respectively, pin of the hearing device housing if the battery bay is located in the closed position and the securing element 20 is located in the secured position, as is explained in detail below.

Furthermore, the securing element 20 likewise has pressure surfaces 26 at the wedge-shaped molded parts 27, which pressure surfaces 26 interact with the projections of the hearing device housing if the battery bay 10 is located in the open position and the securing element 20 is located in the closed position, and the battery bay 10 is thereby pivoted into the closed position. The pressure surfaces exhibit an angle of approximately 40° to 60° relative to the retaining surfaces, such that a retaining surface 25 and a corresponding pressure surface 26 respectively form a wedge (wedge-shaped molded part 27) that point toward the center of the battery bay 10.

The function of the battery bay is now explained in detail using FIG. 3 through FIG. 8. Only the elements of FIG. 2 in the assembled state and electrical battery contacts 40 and, additionally, a pin or, respectively, projection 50 of a hearing device housing or a housing shell are shown. Moreover, a segment of a housing shell half 60 in the region of the battery bay is indicated for orientation.

Figure 3:
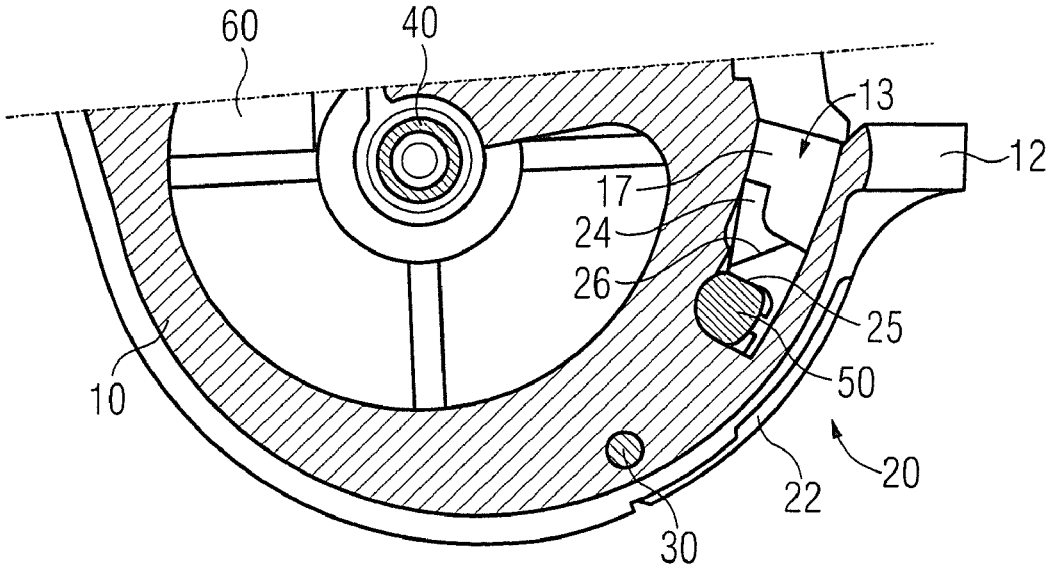
FIG. 3 is a side view of a battery bay in the closed position and of the securing element in the secured position.

FIG. 3 shows the battery bay 10 in the closed position in side view. This means that the central axis of the cylindrical battery bay 10 travels approximately through the middle of the battery contact 40. The projection 50 of the second housing shell half (not shown) is penetrated up to the floor of the pocket-shaped recess 13 of the battery bay 10. It limits the movement of the battery bay 10 at the closed position.

The securing element 20 that is borne such that it can pivot on the pin 30 is located in the secured position. This means that the battery bay 10 is secured against unwanted opening. For this purpose the retaining surface 25 of the securing element 20 engages behind the projection 50 of the housing or the housing shell half. The retaining surface 25 defines a plane on whose one side lies the projection 50 lies and on whose other side lies the rotation axis of the battery bay 10. This means that this retaining surface plane is somewhat inclined relative to that plane that is spanned by the contact point or, respectively, the contact surface between retaining surface 25 and projection 50 and the rotation axis of the battery bay 10. This inclination (<30°, in particular <10°) has the effect that, upon attempting to open the battery bay 10, the wedge-shaped molded part 27 with the retaining surface 25 of the securing element 20 pulls the entire securing element 20 more strongly into the secured position. The event that the securing element 20 is pushed into the secured position upon attempting to open the battery bay 10 is thus prevented.

Figure 4:
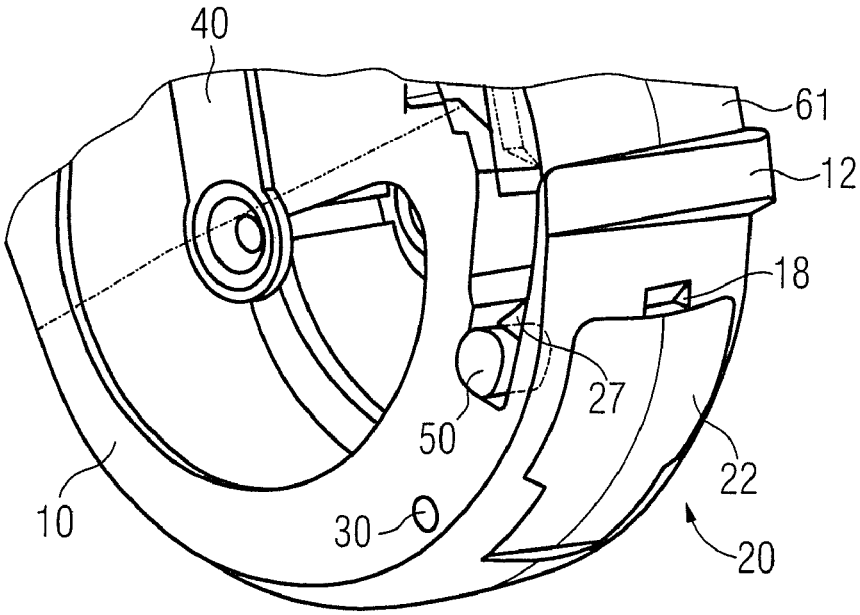
FIG. 4 shows the battery bay of FIG. 3 in a perspective view.

The battery bay from FIG. 3 is shown in an angled view in FIG. 4. Here in particular the control surface 22 of the securing element 20 is recognizable. In the secured position it is flush with the surface of the battery bay 10. Furthermore, the securing element 20 together with the opening 18 forms a slit through which a small screwdriver can engage in the recess 23 (not visible in FIG. 4) of the securing element 20 in order to move the securing element 20 into the unsecured position.

Figure 5:
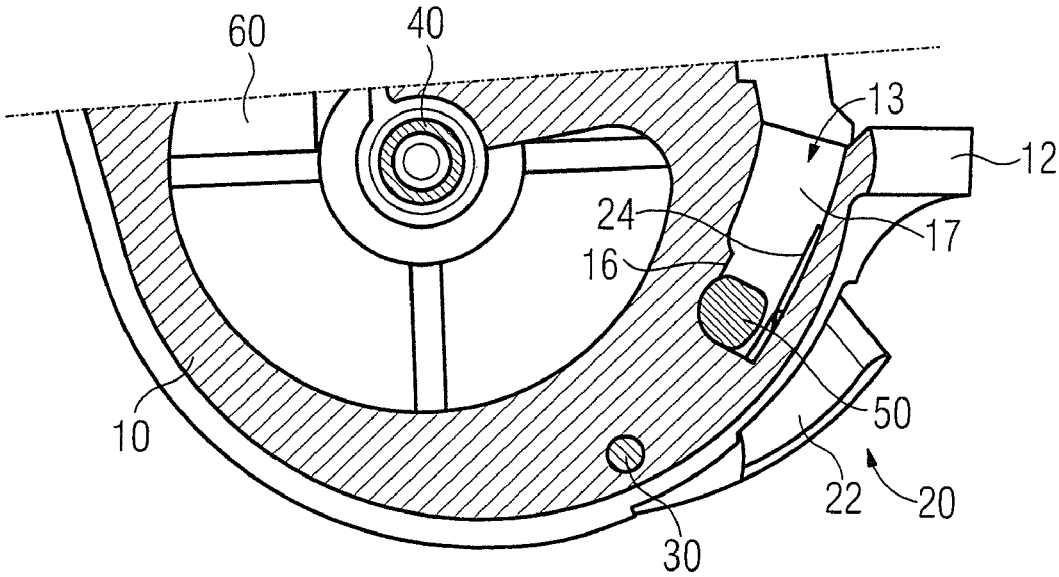
FIG. 5 is a side view of the battery bay in the closed position and of the securing element in the unsecured position.

In FIG. 5 the battery bay 10 is shown as before in the closed position, meaning that the projection 50 is located on the floor of the recess-shaped opening 13. The securing element 20 is, however, pivoted out of the battery bay 10 and is located in the unsecured position. This means that the wedge-like molded part 27 of the securing element 20 no longer engages behind the projection 50 the housing. The stop 24 thereby rests on the wall of the recess-shaped opening 13 below the grip element 12. The projection 16 holds the battery bay 10 still latched in the closed position. However, it is apparent that the battery bay can be detached from this catch mechanism with some pressure, and the recess-shaped opening 13 is open to the outside.

Figure 6:
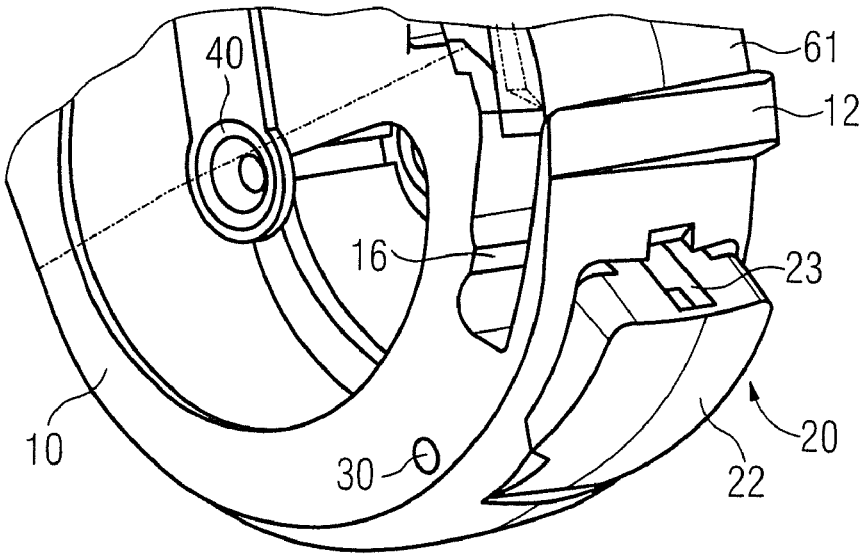
FIG. 6 shows the battery bay of FIG. 5 in a perspective view.

The state of the battery bay from FIG. 5 is shown in the angled view in FIG. 6. While the depiction of the projection 50 is omitted here, the recess 23 of the securing element 20 is easily recognizable in the image, in which recess 23 a screwdriver can engage in order to release the securing element.

Figure 7:
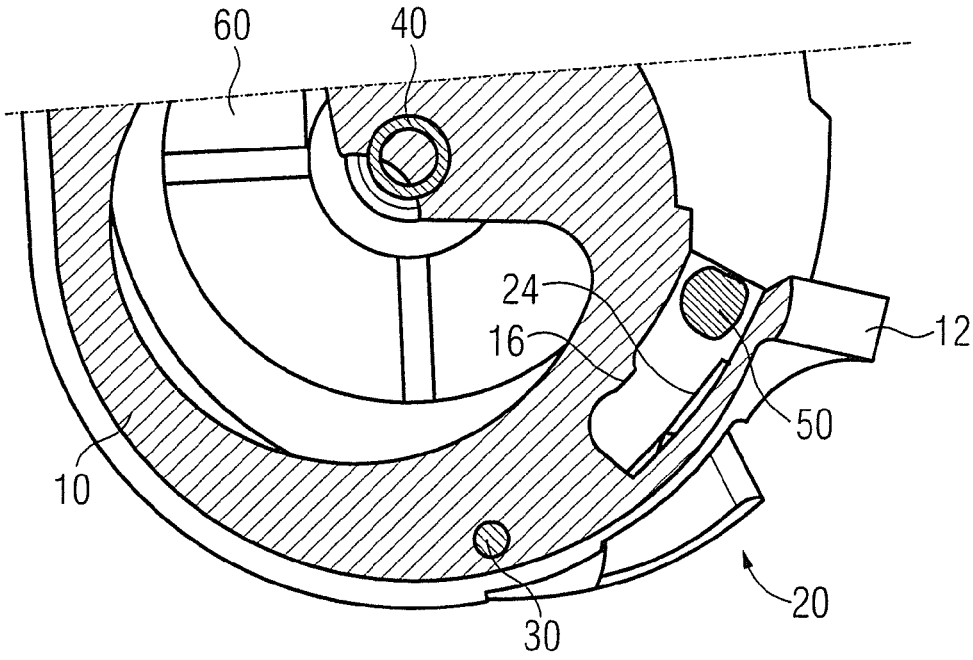
FIG. 7 shows a side view of the battery bay in the open position and of the securing element in the unsecured position.

The state that the battery bay is moved out of the closed position into an open position is now shown in FIG. 7. This means that the projection 50 was pressed over the projection 16 into the recess-shaped opening 13 and here is already located at the exit of the opening 13.

Figure 8:
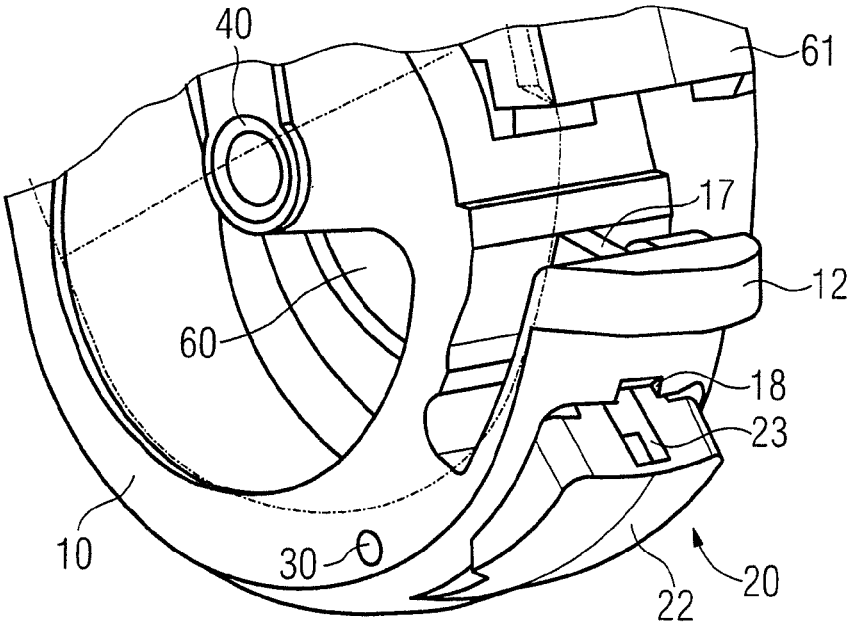
FIG. 8 shows the battery bat of FIG. 7 in a perspective view.

FIG. 8 in turn shows the battery bay 10 from FIG. 7 in angled view. The battery bay 10 is partially open, such that a clear gap results between the grip element 12 and a segment 61 of the housing 60 or of the housing shell half.

As FIG. 5 through FIG. 8 show, the hearing device wearer can immediately tactilely or optically detect, using the position of the securing element 20, that the securing element 20 is located in the unsecured position. In the secured position, the securing element 20 according to FIG. 3 through 4 is flush with the surface.

In the event that the battery bay is closed again and the securing element 20 is located in the secured position, it is pushed by the run-up slope (i.e. the pressure surfaces 26 of the wedge-shaped molded parts 27) from the projections 50 on both sides of the housing shell half 60. The securing element 20 (that is initially located in the secured position) therefore does not prevent the closing of the battery bay. This then latches in the closed position via the projection 16, and the securing element 20 can be pressed into the secured position at the control surface 22, which is shown in FIG. 3.

The projections 50 that protrude from both sides into the recesses 13 of the battery bay 10 represent a buttress in order to offer a sufficient retention force against the forcible opening of the battery bay. The locking on both sides ensures a two-fold securing agency relative to a single-sided securing mechanism.

Although modifications and changes may be suggested by those skilled in the art, it is the intention of the inventors to embody within the patent warranted hereon all changes and modifications as reasonably and properly come within the scope of their contribution to the art.

We claim as our invention:

1. A housing for a hearing device, comprising:

a housing structure configured to be worn at an ear of a person, said housing structure having an interior and an exterior;

a battery bay mounted in said interior of said housing structure for pivoting movement into an open position, in which said battery bay is accessible from said exterior of said housing structure, and a closed position in which said battery bay is inaccessible from said exterior of said housing structure;

a projection that is permanently attached to said housing structure; and a securing element mounted in said battery bay and being pivotable between a secured position and an unsecured position, said securing element, in said secured position, engaging behind said projection when said battery bay is in said closed position and thereby preventing movement of said battery bay into said open position, and said security element comprising a recess therein that is accessible with a tool from said exterior of said housing structure, said securing element being configured so that, when said tool engages said recess, said securing element is released from engagement behind said projection to allow said securing element to move into said unsecured position, thereby also allowing said battery bay to move into said open position.

2. A housing as claimed in claim 1 wherein said battery bay has an exterior battery bay surface, and wherein said securing element, in said secured position, is substantially flush with said exterior battery bay surface.

3. A housing as claimed in claim 1 wherein said battery bay comprises an opening accessible from the exterior of said housing structure configured to allow said tool to proceed through said opening to access said recess.

4. A housing as claimed in claim 3 wherein said opening in said battery bay is bordered by said securing element to form a slit on said exterior surface of said battery bay having a maximum dimension of 3 mm.

5. A housing as claimed in claim 1 wherein said securing element is configured to lock said battery bay in said closed position when said securing element is in said secured position.

6. A housing as claimed in claim 1 wherein said battery bay is pivotably mounted in said housing structure to rotate between said open position and said closed position, said battery bay pivoting around a pivot access.

7. A housing as claimed in claim 6 wherein said securing element comprises a retaining surface that, in said secured position of said securing element, rests on said projection and is angled by less than 30° relative to a plane containing a contact point of the securing element with said projection, and said pivot access.

8. A housing as claimed in claim 7 wherein said retaining surface rests on said projection at an angle of less than 10°.

9. A housing as claimed in claim 1 wherein said securing element comprises a pressure surface against which said projection presses when said battery bay is moved into said closed position, causing said securing element to be pressed into said secured position.

10. A housing as claimed in claim 1 wherein said securing element comprises a stop that prevents movement of said securing element upon movement of said securing element into said secured position.

* * * * *